United States Patent [19]

Vandermeersch

[11] Patent Number: 5,069,957

[45] Date of Patent: Dec. 3, 1991

[54] FIRE RESISTANT ELASTIC STRAP

[75] Inventor: Edmond Vandermeersch, Comines, Belgium

[73] Assignee: S.A.R.L. "Matiba-Manufactures de Tissus", Wervicq-Sud, France

[21] Appl. No.: 607,517

[22] Filed: Nov. 1, 1990

[30] Foreign Application Priority Data

Dec. 22, 1989 [FR] France ..... 89 17283

[51] Int. Cl.[5] ..... D03D 3/00

[52] U.S. Cl. ..... 428/230; 428/229; 428/231; 428/257; 428/258; 428/259; 428/373; 428/377; 428/920

[58] Field of Search ..... 428/229, 230, 231, 257, 428/258, 259, 377, 920, 373

[56] References Cited

U.S. PATENT DOCUMENTS

| | | | |
|---|---|---|---|
| 4,500,593 | 2/1985 | Weber | 428/377 |
| 4,670,327 | 6/1987 | Weber | 428/377 |
| 4,728,565 | 3/1988 | Fontana | 428/257 |
| 4,812,011 | 3/1989 | Tatsukami et al. | 428/373 |
| 4,842,369 | 6/1989 | Teshima et al. | 428/373 |
| 4,865,906 | 9/1989 | Smith | 428/373 |
| 4,902,548 | 2/1990 | Serpoud | 428/377 |
| 4,958,485 | 9/1990 | Montgomery et al. | 428/377 |

*Primary Examiner*—James J. Bell

*Attorney, Agent, or Firm*—Harrison & Egbert

[57] ABSTRACT

The invention relates to a fire resisting elastic strap designed, for furnishing purposes, to serve in the making of seat or bed suspensions satisfying criteria for safety in the event of fire.

The strap is formed by weaving elastic threads placed in the warp and/or in the weft. According to the invention, the elastic thread has a core (4) of elastic material and a continuous longitudinally deformable cladding of fire resistant material. The cladding is preferably formed by wrapping in opposite directions two threads (6 and 7) of fire resisting material such as FR viscose.

The invention primarily concerns the textile industry.

9 Claims, 1 Drawing Sheet

FIRE RESISTANT ELASTIC STRAP

Figure 1:
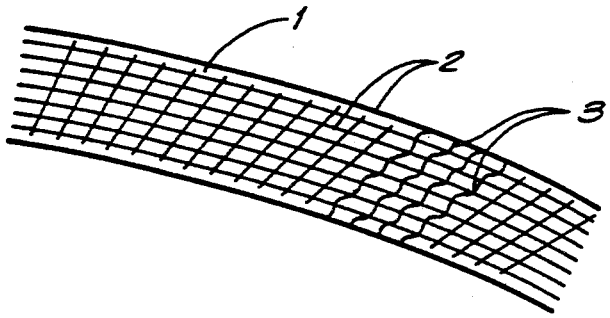

The invention relates to a fire resisting elastic strap which will find an application particularly in the furniture industry, especially for the purpose of making seat or bed suspensions.

Although the invention has been specially developed for the manufacture of elastic straps, it can be further extended to include any textile structure that uses at last elastic thread, as encountered, for example, in certain knitted garments.

More and more frequently, for example in public transport, public places, aircraft, railways and others, it is becoming habitual to use seats that have an ability to resist fires by not propagating flames and not giving off any toxic fumes. Those constructors concerned have thus turned to the development of new fabrics having good fire resisting properties.

The main problem encountered concerns the synthetic materials used. For example, seats are often upholstered using synthetic foam such as polyurethane foam, which presents very poor qualities in the event of fire.

In fact, the main objective is that the "whole" of the components of a seat should behave satisfactorily in the case of fire. In theory, while it is acceptable to design a seat containing foam that is not fire-resistant but which is protected by a fabric that serves as a heat shield, in practice, the heat is liable to cause the release of toxic fumes given off by the foam, which will be "consumed" rather than "burn".

Another solution consists in using to cover the foam a fabric which, in the event of excessive heat, is able to form a heat shield to prevent the foam from catching fire.

This technique is suitable when one is dealing with fabrics that are flexible but not elastic. Indeed, by definition, an elastic fabric becomes deformed and, under these conditions, it is extremely difficult to maintain the continuity of the heat shield. Now, in any elastic fabric, the property of elongation and retraction is conferred by incorporating a continuous length of elastic thread. This elastic thread, whether it be made using natural rubber or a synthetic material, almost always has very poor fire resisting properties It propagates flames, being combustible, and gives off toxic fumes.

Hitherto, by very reason of the presence of this continuous elastic thread in the texture of the fabric, it has never been possible to develop an elastic strap having fire resisting properties, in compliance with the safety standards laid down in this respect.

The main aim of the present invention is to provide a fire resisting elastic strap that is capable, on one hand, of meeting the requirements of comfort, particularly with regard to the making of seat or bed suspensions and, on the other hand, which can be approved as to safety for conformity, in particular, with the following standards, for example: FAR 25853 (aviation), Motor Vehicle Safety Standard No. 302 and NF P 92-503, the latter permitting classification of the strap in category M2 or M3.

Another object of the present invention is to provide an elastic strap that can be made using the traditional weaving machines, that is to say without any additional production costs being incurred. The threads used must, of course, conform to the characteristics of the invention.

Further objects and advantages of the present invention wil1 emerge in the course of the following description which is given. however, only by way of example and is not intended to limit same.

According to the invention, the fire resisting elastic strap, intended in particular, in the field of furnishing, to be used in the making of seat or bed suspensions, satisfying certain criteria of safety in the event of fire, the said strap being formed by weaving elastic threads placed in a warp and/or a weft, is characterized by the fact that the elastic thread has a core of elastic material and a continuous longitudinally deformable cladding of anti-fire material.

Figure 2:
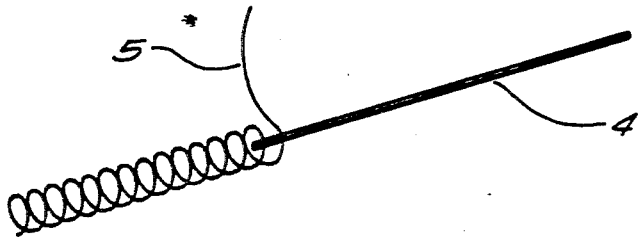
Figure 3:
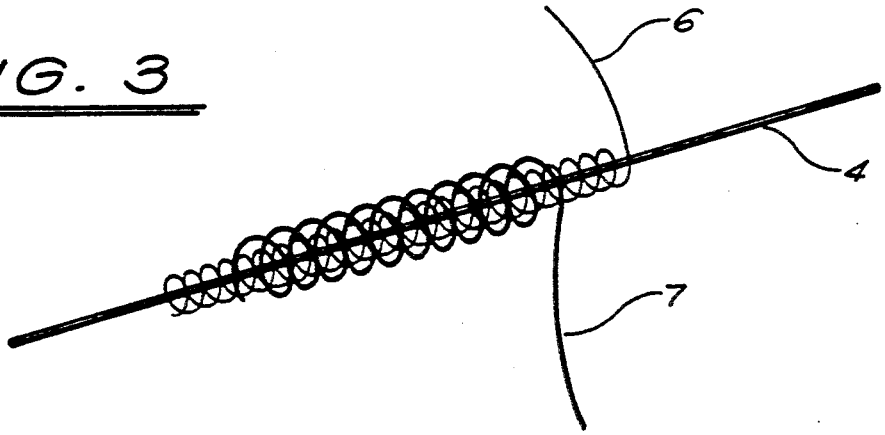

The invention will be more readily understood from reading the following description accompanied by the annexed drawings wherein:

FIG. 1 schematically represents a piece of fire resisting elastic strap,

FIG. 2 schematically represents the structure of the elastic thread used in making the fire resisting elastic strap, FIG. 3 represents a preferred form of embodiment of the structure of the elastic thread used to make the fire resisting elastic strap of the present invention.

The invention relates to a fire resisting elastic strap which will find an application in particular in the field of furnishing, especially in the making of seat or bed suspensions, and which meets certain fire safety requirements.

To limit the risks of fires in public places, public transport, aircraft or others, standards have been laid down to govern the characteristics of the materials employed. Thus, in the case of furnishing, it is required to use non flame propagating lining fabrics and upholstering materials.

Through the appropriate use of fire resisting fibres, it has been possible to produce fabrics offering good fire fighting properties, in particular by forming heat shields to prevent the propagation of heat within the upholstering material, generally polyurethane foam, which is highly sensitive to flames. There now exist flame retardant foams.

As regards elastic fabrics, the problem that is posed is their deformability, which does not allow a fire resisting fibre to be used in a simple manner in order to form a protective shield for the continuous elastic thread. Hitherto, elastic threads have not made it possible to meet the safety standards laid down for their use in certain applications.

The elastic strap according to the present invention makes it possible to solve the problems encountered hitherto with the materials available on the market. Use will be made of traditional materials, which makes it possible, in particular, to obtain a good cost price, and the "fire resisting" effect sought after is obtained thanks to a very special arrangement of the materials.

The elastic effect of the strap is obtained by incorporating a continuous elastic thread into the structure of the strap. This continuous elastic thread, whether it be natural or synthetic rubber, proves consistently unsuitable as regards non flame propagation and the giving off of toxic fumes. The object of the present invention is to succeed, despite the use of such an elastic thread, in obtaining a product that is capable of not propagating flames. A concrete example of the making of such a strap is given at the end of the description.

FIG. 1 shows a piece of elastic strap (1) that appears externally perfectly traditional. Generally, the width of the straps ranges from fifteen millimeters to eighty millimeters, depending on the intended use. The strap is made by weaving warp threads (2) interlaced with weft threads (3) to form a weave defined in accordance with requirements. It should be emphasized that the invention does not present any particular constraints in this connection. Consequently, for the manufacturer, the weaving of the strap remains rigorously identical with the making of a traditional elastic strap.

According to the properties sought after, the elastic thread or threads can be incorporated in the warp and/or the weft. Generally, it is in the warp that the elastic thread is placed and, for economic reasons, not all the warp threads are systematically elastic.

The non elastic threads satisfy fire resisting requirements without any difficulty. There are numerous threads in the industry that are made using fire resisting materials, and weaving does not modify their properties.

As to the elastic thread used according to the present invention, this has an elastic core and a continuous, longitudinally deformable cladding of fire resisting material.

The core of elastic material is entirely traditional, being a continuous thread of rubber or elastomer, whether natural or synthetic.

On the other hand, the cladding has special properties; it must firstly be continuous to form a permanent shield whatever the elongation of the elastic material to prevent flame propagation.

This cladding can, for example, take the form of a wrapped round thread, as illustrated in FIG. 2. The elastic core (4) is surrounded by one or more threads (5). The latter is/are made of fire resisting material and, although not possessing any elastic property, can, because of the wrapping, follow the elongations of the elastic central core (4) while still forming a continuous peripheral shield.

This cladding thread (5) can be made of different materials, such as FR visoose FR (FR="Fire Retardant") anti-fire polyester, chlorinated fibres, Aramide fibres or others.

More advantageously, the cladding of the elastic core (4) can be obtained by placing one or more threads wrapped in opposite directions (6 and 7), as illustrated in FIG. 3. The reversal of the wrapping directions reinforces the covering ability of the cladding threads. The outer cladding thread(s) can be, for example, one or more twisted threads which thus possess good resistance properties.

Another type of cladding that has also given some successful results when tested has been produced by crocheting a thread of fire resisting fibres around the elastic core.

By way of a first example, a sample was made using for the warp sixty or so threads wrapped around a core of polyurethane latex based rubber, such as a thread of rubber known by the name of GLOSSPAN, of 4300 deniers. The wrapping is formed by a first thread of FR viscose, 12 Nm, and by a second double thread, 2/12 Nm, also of FR viscose.

The weft has 3.9 weft threads per centimeter of FR viscose, 2 Nm 4/1.

The weaving is carried out with supply threads. Rupture takes place at 140 kilograms for 150% elongation. The strap weighs 75 grammes per meter.

Tests were carried out using an elastic strap made in accordance with the characteristics of the invention, the strap having a width of 80 millimeters. The results for fire behaviour according to aviation standard FAR 26863 were 0 seconds of post-combustion and a burnt length of 5 millimeters. The strap tested was held vertically, ignited on the edge using a gas burner for 12 seconds. To conclude, the sample met the acceptance criteria for the method:

mean burnt length less than 203 millimeters and flame extinction time after removal of the burner (post-combustion) less than 15 seconds.

According to the Motor Vehicle Safety Standard No. 302, the test for flame propagation in horizontal position with ignition by the edge using a gas burner for 15 seconds resulted in the absence of propagation after removal of the burner for the three test-pieces concerned.

Under these conditions, the strap meets the method acceptance criteria.

In the case of the test using the electric burner of standard NF P 92-503, which tests the reaction to fire of flexible materials with a thickness less than or equal to 5 millimeters, used in buildings open to the public or very high buildings, the sample caught fire after 50 seconds had elapsed following the start of the test. Combustion lasted for 41 seconds and the length destroyed was 250 millimeters. This test makes it possible to place the sample in class M2.

According to fire resistance testing and classification as a function of the surface burnt in conformity with standard NF G 07-113, in which the test piece is held vertical, with ignition by the edge using a calibrated fuse of polyester-cotton, the sample presented a burnt surface of 0 square centimeters. Under these conditions, the sample was placed in class B (the best class for this test standard).

The different tests conducted showed that the elastic strap met the severest requirements of the different international standards.

For the purpose of conforming, in particular, to the FAR 25853 standards, a strap as in the following example was also developed: use of 40 threads wrapped according to the principle previously described, composed as follows:

synthetic rubber, known by the name of GLOSSPAN:2 No. 24 threads, square inner cladding: 2 threads of polyvinyl, known by the name of CLEVYL, Nm 1/20 outer cladding: 2 threads of polyvinyl, known by the name of CLEVYL, Nm 1/20

Thus, for a 1 meter of wrapped thread, we have:

1.3 g of bare rubber 1 g of polyvinyl elongation of wrapped thread: 230% weft: 2 juxtaposed threads of Nm 2/20 polyvinyl (Clevyl) 4 weft threads per centimeter width of strip: 60 mm weight per meter 93.8 g.

Such a sample produced favourable results in the "fire behaviour" test, a horizontal test equivalent to FAR 25853 (b-2) since, after the burner had been removed, there was neither persistence nor propagation of the flame.

Other embodiments of the present invention, within the reach of a man of the art, could likewise have been contemplated without thereby departing from the scope thereof. In particular, the invention is not confined to the making of elastic straps but is more generally applicable to all textures using elastic thread.

I claim:

1. Fire resisting elastic strap, designed in particular for furnishing purposes for use in the making of seat or bed suspensions, meeting criteria for safety in the event of fire, the said strap (1) being formed by weaving elastic threads placed in a warp (2) and/or in a weft (3), characterized by the fact that the elastic thread has a core (4) of elastic material and a continuous. longitudinally deformable cladding (5) of fire resisting material.

2. Fire resisting elastic strap according to claim 1, characterized by the fact that the core (4) is composed of a natural elastic rubber or a synthetic elastomer.

3. Fire resisting elastic strap according to claim i, characterized by the fact that the cladding is composed of a fire resisting wrapped thread (5).

4. Fire resisting elastic strap according to claim 1, characterized by the fact that the cladding is composed of two or more threads (6 and 7) of fire resisting material, wrapped in opposite directions around the elastic core (4).

5. Fire resisting elastic strap according to claim 1, characterized by the fact that the cladding is formed by a fire resisting thread crocheted around the elastic core (4).

6. Fire resisting elastic thread according to claim 3 characterized by the fact that the cladding is composed of an FR viscose thread.

7. Fire resisting elastic strap according to claim 4, characterized by the fact that the outer wrapping thread (7) is a twisted or doubled thread.

8. Fire resisting elastic strap according to claim 7, characterized by the fact that it is composed of a 4300 denier polyurethane latex based rubber core covered by wrapping a first 12 Nm FR viscose thread and a 2/12 Nm FR viscose doubled thread placed in the opposite direction in relation to the first.

9. Fire resisting elastic strap according to claim 7, characterized by the fact that it is composed of a polyurethane latex based rubber core taking the form of two No. 24 square threads, covered by an inner cladding and by an outer cladding each made from two 1/20 Nm polyvinyl threads.

* * * * *